US011455928B2

(12) United States Patent
Wang et al.

(10) Patent No.: US 11,455,928 B2
(45) Date of Patent: Sep. 27, 2022

(54) PIXEL STRUCTURE, DRIVING METHOD AND DISPLAY DEVICE

(71) Applicants: Fuzhou BOE Optoelectronics Technology Co., Ltd., Fujian (CN); BOE TECHNOLOGY GROUP CO., LTD., Beijing (CN)

(72) Inventors: Jianshu Wang, Beijing (CN); Chunyu Li, Beijing (CN); Bo Hu, Beijing (CN)

(73) Assignees: FUZHOU BOE OPTOELECTRONICS TECHNOLOGY CO., LTD., Fujian (CN); BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 17/356,193

(22) Filed: Jun. 23, 2021

(65) Prior Publication Data

US 2022/0198976 A1 Jun. 23, 2022

(30) Foreign Application Priority Data

Dec. 23, 2020 (CN) ..... 202011536993.6

(51) Int. Cl.
*G09G 3/20* (2006.01)

(52) U.S. Cl.
CPC ..... *G09G 3/20* (2013.01); *G09G 2300/0426* (2013.01); *G09G 2300/0439* (2013.01); *G09G 2300/08* (2013.01); *G09G 2310/0251* (2013.01); *G09G 2310/0267* (2013.01); *G09G 2310/0275* (2013.01); *G09G 2320/0242* (2013.01)

(58) Field of Classification Search
CPC ..... G09G 2300/0452; G09G 3/3648; G09G 2300/0426; G09G 2310/0297; G09G 2310/02; G09G 3/2074; G09G 2310/0202
See application file for complete search history.

(56) References Cited

U.S. PATENT DOCUMENTS

2017/0039972 A1* 2/2017 Li ..... G09G 3/3648
2019/0259324 A1* 8/2019 Liu ..... G09G 3/20

* cited by examiner

*Primary Examiner* — Gerald Johnson
(74) *Attorney, Agent, or Firm* — McCoy Russell LLP

(57) ABSTRACT

A pixel structure, a driving method and a display device are provided. The pixel structure includes a plurality of gate lines arranged in rows, a plurality of data lines arranged in columns, and a plurality of subpixel circuits arranged in an array form. Each subpixel circuit includes a subpixel and a switching element, the subpixel is electrically connected to one of the data lines via the switching element, a control electrode of the switching element is electrically connected to one of the gate lines, and the subpixels electrically connected to the same data line are in a same color.

19 Claims, 5 Drawing Sheets

PIXEL STRUCTURE, DRIVING METHOD AND DISPLAY DEVICE

CROSS-REFERENCE TO RELATED APPLICATION

The present application claims priority to Chinese Patent Application No. 202011536993.6 filed on Dec. 23, 2020. The entire contents of the above-listed application is hereby incorporated by reference for all purposes.

TECHNICAL FIELD

The present disclosure relates to the field of display technology, in particular to a pixel structure, a driving method and a display device.

BACKGROUND

For a screen with a high refresh rate, it has a lower display delay and a faster response speed, so as to provide a more smooth visual effect. In the context of "high network speed and low latency" in a 5th-Generation (5G) era, the screen with a high refresh rate is capable of improving the visual effect as well as image continuity, so it has attracted more and more attention.

In the related art, two gate lines may be turned on simultaneously, so as to charge two rows of subpixels simultaneously and double a charging time, thereby to double the refresh rate. However, based on a pixel structure in the related art, such a phenomenon as color contamination may occur when the charging time for a subpixel circuit is doubled, and such problems as fine pitch and horizontal stripes may occur during dot inversion.

SUMMARY

A main object of the present disclosure is to provide a pixel structure, a driving method and a display device, so as to solve the above-mentioned problems.

In one aspect, the present disclosure provides in some embodiments a pixel structure, including a plurality of gate lines arranged in rows, a plurality of data lines arranged in columns, and a plurality of subpixel circuits arranged in an array form, wherein each of the subpixel circuitries includes a subpixel and a switching element; the subpixel is electrically connected to one of the data lines via the switching element, a control electrode of the switching element is electrically connected to one of the gate lines; the subpixels electrically connected to the same data line are in a same color.

In a possible embodiment of the present disclosure, the switching element is configured to control to charge the subpixel through a data voltage on the data line under control of a gate driving signal on the gate line.

In a possible embodiment of the present disclosure, the control electrodes of the switching elements of the subpixel circuits in a same row are electrically connected to the same gate line; in the plurality of subpixel circuits arranged in the array form, a subpixel circuit in a $(2n-1)^{th}$ row and an $m^{th}$ column is electrically connected to an $m^{th}$ first gate line, and a subpixel circuit in a $(2n)^{th}$ row and the $m^{th}$ column is electrically connected to an $m^{th}$ second data line; and the $m^{th}$ first data line is a data line in an $m^{th}$ column among the plurality of data lines arranged in the columns, and the $m^{th}$ second data line is a data line in an $m^{th+1}$ column among the plurality of data lines arranged in the columns; or the $m^{th}$ first data line is the data line in the $m^{th+1}$ column among the plurality of data lines arranged in the columns, and the $m^{th}$ second data line is the data line in the $m^{th}$ column among the plurality of data lines arranged in the columns, where m and n are both positive integers.

In a possible embodiment of the present disclosure, the subpixel circuit in the $(2n-1)^{th}$ row and the $m^{th}$ column includes a subpixel in a $(2n-1)^{th}$ row and an $m^{th}$ column and a switching element in a $(2n-1)^{th}$ row and an $m^{th}$ column, a control electrode of the switching element in the $(2n-1)^{th}$ row and the $m^{th}$ column is electrically connected to a gate line in a $(2n-1)^{th}$ row, a first electrode of the switching element in the $(2n-1)^{th}$ row and the $m^{th}$ column is electrically connected to the $m^{th}$ first data line, and a second electrode of the switch element in the $(2n-1)^{th}$ row and the $m^{th}$ column is electrically connected to the subpixel in the $(2n-1)^{th}$ row and the $m^{th}$ column; the subpixel circuit in the $(2n)^{th}$ row and the $m^{th}$ column includes a subpixel in a $(2n)^{th}$ row and an $m^{th}$ column and a switching element in a $(2n)^{th}$ row and an $m^{th}$ column, a control electrode of the switching element in the $(2n)^{th}$ row and the $m^{th}$ column is electrically connected to a gate line in the $(2n)^{th}$ row, a first electrode of the switching element in the $(2n)^{th}$ row and the $m^{th}$ column is electrically connected to the $m^{th}$ second data line, and a second electrode of the switch element in the $(2n)^{th}$ row and the $m^{th}$ column is electrically connected to the subpixel in the $(2n)^{th}$ row and the $m^{th}$ column.

In a possible embodiment of the present disclosure, the switching element is a triode, a Thin Film Transistor (TFT) or a Field Effect Transistor (FET).

In a possible embodiment of the present disclosure, the switching element further includes a first electrode and a second electrode, the subpixel is connected to the first electrode of the switching element, and the data line is connected to the second electrode of the switching element.

In another aspect, the present disclosure provides in some embodiments a driving method for the above-mentioned pixel structure, including controlling at least two gate lines in the plurality of gate lines to output an effective gate driving signal simultaneously, to turn on the switching elements whose control electrodes are electrically connected to the at least two gate lines.

In a possible embodiment of the present disclosure, in the plurality of subpixel circuits arranged in the array form, a subpixel circuit in a $(2n-1)^{th}$ row and an $m^{th}$ column includes a subpixel in a $(2n-1)^{th}$ row and an $m^{th}$ column and a switching element in a $(2n-1)^{th}$ row and an $m^{th}$ column, a control electrode of the switching element in the $(2n-1)^{th}$ row and the $m^{th}$ column is electrically connected to a gate line in a $(2n-1)^{th}$ row, a first electrode of the switching element in the $(2n-1)^{th}$ row and the mm column is electrically connected to an $m^{th}$ first data line, and a second electrode of the switch element in the $(2n-1)^{th}$ row and the $m^{th}$ column is electrically connected to the subpixel in the $(2n-1)^{th}$ row and the $m^{th}$ column; a subpixel circuit in a $(2n)^{th}$ row and an $m^{th}$ column includes a subpixel in a $(2n)^{th}$ row and an $m^{th}$ column and a switching element in a $(2n)^{th}$ row and an $m^{th}$ column, a control electrode of the switching element in the $(2n)^{th}$ row and the $m^{th}$ column is electrically connected to a gate line in the $(2n)^{th}$ row, a first electrode of the switching element in the $(2n)^{th}$ row and the $m^{th}$ column is electrically connected to the $m^{th}$ second data line, and a second electrode of the switch element in the $(2n)^{th}$ row and the $m^{th}$ column is electrically connected to the subpixel in the $(2n)^{th}$ row and the $m^{th}$ column; the $m^{th}$ first data line is a data line in an $m^{th}$ column among the plurality of data lines arranged in the columns, and the $m^{th}$ second data line is a data line in an $m^{th+1}$ column among the plurality of data lines arranged in the columns; or the $m^{th}$ first data line is the data line in the $m^{th+1}$ column among the plurality of data lines arranged in the columns, and the $m^{th}$ second data line is the data line in the $m^{th}$ column among the plurality of data lines arranged in the columns, where m and n are both positive integers. The display period includes a plurality of display stages, and the driving method includes: at an $n^{th}$ display stage among the display stages, controlling the gate line in the $(2n-1)^{th}$ row and the gate line in the $(2n)^{th}$ row to output the effective gate driving signals simultaneously, to turn on the switching elements whose control electrodes are electrically connected to the gate line in the $(2n-1)^{th}$ row and the switching elements whose control electrodes are electrically connected to the gate line in the $(2n)^{th}$ row, and enable the data lines to provide respective $n^{th}$ data voltages to charge the corresponding subpixels.

In a possible embodiment of the present disclosure, the display period further includes a pre-charging stage between adjacent display stages, wherein the pre-charging stage between an $n^{th}$ display stage and an $(n+1)^{th}$ display stage is an $n^{th}$ pre-charging stage; the driving method further includes: at the $n^{th}$ pre-charging stage, controlling the gate line in the $(2n-1)^{th}$ row, the gate line in the $(2n)^{th}$ row, a gate line in a $(2n+1)^{th}$ row and a gate line in a $(2n+2)^{th}$ row to provide the effective gate driving signals, to turn on the switching elements whose control electrodes are electrically connected to the gate line in the $(2n-1)^{th}$ row, the switching elements whose control electrodes are electrically connected to the gate line in the $(2n)^{th}$ row, the switching elements whose control electrodes are electrically connected to the gate line in the $(2n+1)^{th}$ row and the switching elements whose control electrodes are electrically connected to the gate line in the $(2n+2)^{th}$ row, and enable the data lines to provide the respective $n^{t}$ data voltages to charge the corresponding subpixels.

In yet another aspect, the present disclosure provides in some embodiments a display device including the above-mentioned pixel structure.

In a possible embodiment of the present disclosure, the display device further includes a gate driving circuit and a data driving circuit, the gate driving circuit is configured to control at least two gate lines in the plurality of gate lines to output effective gate driving signals simultaneously, to turn on the switching elements whose control electrodes are electrically connected to the at least two gate lines; the data driving circuit is configured to provide a corresponding data voltage to the data line.

In a possible embodiment of the present disclosure, in the plurality of subpixel circuits arranged in the array form, a subpixel circuit in a $(2n-1)^{th}$ row and an $m^{th}$ column includes a subpixel in a $(2n-1)^{th}$ row and an $m^{th}$ column and a switching element in a $(2n-1)^{th}$ row and an $m^{th}$ column, a control electrode of the switching element in the $(2n-1)^{th}$ row and the $m^{th}$ column is electrically connected to a gate line in a $(2n-1)^{th}$ row, a first electrode of the switching element in the $(2n-1)^{th}$ row and the $m^{th}$ column is electrically connected to an $m^{th}$ first data line, and a second electrode of the switch element in the $(2n-1)^{th}$ row and the $m^{th}$ column is electrically connected to the subpixel in the $(2n-1)^{th}$ row and the $m^{th}$ column; a subpixel circuit in a $(2n)^{th}$ row and an $m^{th}$ column includes a subpixel in a $(2n)^{th}$ row and an $m^{th}$ column and a switching element in a $(2n)^{th}$ row and an $m^{th}$ column, a control electrode of the switching element in the $(2n)^{th}$ row and the $m^{th}$ column is electrically connected to a gate line in the $(2n)^{th}$ row, a first electrode of the switching element in the $(2n)^{th}$ row and the $m^{th}$ column is electrically connected to the $m^{th}$ second data line, and a second electrode of the switch element in the $(2n)^{th}$ row and the $m^{th}$ column is electrically connected to the subpixel in the $(2n)^{th}$ row and the $m^{th}$ column; the $m^{th}$ first data line is a data line in an $m^{th}$ column among the plurality of data lines arranged in the columns, and the $m^{th}$ second data line is a data line in an $m^{th+1}$ column among the plurality of data lines arranged in the columns; or the $m^{th}$ first data line is the data line in the $m^{th+1}$ column among the plurality of data lines arranged in the columns, and the $m^{th}$ second data line is the data line in the $m^{th}$ column among the plurality of data lines arranged in the columns, where m and n are both positive integers; a display period includes a plurality of display stages. The gate driving circuit is configured to, at an $n^{th}$ display stage among the display stages, controlling the gate line in the $(2n-1)^{th}$ row and the gate line in the $(2n)^{th}$ row to output the effective gate driving signals simultaneously, to turn on the switching elements whose control electrodes are electrically connected to the gate line in the $(2n-1)^{th}$ row and the switching elements whose control electrodes are electrically connected to the gate line in the $(2n)^{th}$ row; the data driving circuit is configured to, at the $n^{th}$ display stage, provide respective $n^{th}$ data voltages to the data lines, to charge the corresponding subpixels.

In a possible embodiment of the present disclosure, the display period further includes a pre-charging stage between adjacent display stages, wherein the pre-charging stage between an $n^{th}$ display stage and an $(n+1)^{th}$ display stage is an $n^{th}$ pre-charging stage; and the gate driving circuit is configured to, at the $n^{th}$ pre-charging stage, control the gate line in the $(2n-1)^{th}$ row, the gate line in the $(2n)^{th}$ row, a gate line in the $(2n+1)^{th}$ row and a gate line in the $(2n+2)^{th}$ row to provide the effective gate driving signals to turn on the switching elements whose control electrodes are electrically connected to the gate line in the $(2n-1)^{th}$ row, the switching elements whose control electrodes are electrically connected to the gate line in the $(2n)^{th}$ row, the switching elements whose control electrodes are electrically connected to the gate line in the $(2n+1)^{th}$ row and the switching elements whose control electrodes are electrically connected to the gate line in the $(2n+^{2})^{th}$ row; the data driving circuit is configured to, at the $n^{th}$ pre-charging stage, provide the respective $n^{th}$ data voltages to the data lines, to charge the corresponding subpixels.

DETAILED DESCRIPTION

Figure 1:
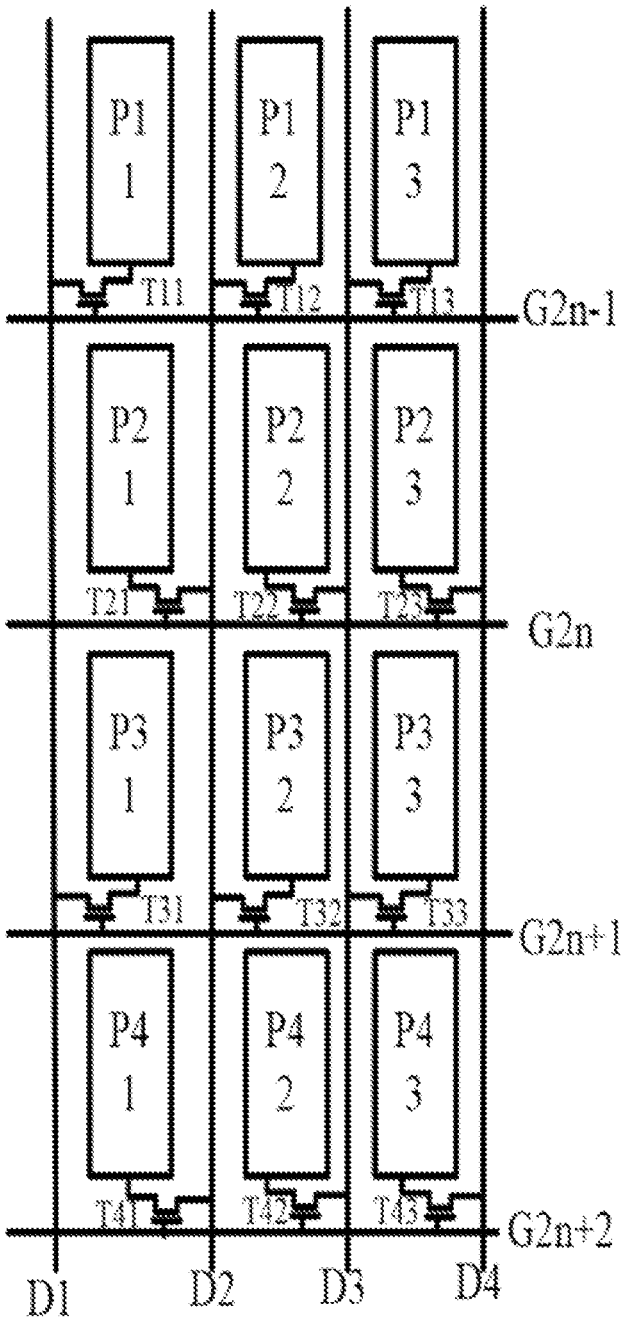
FIG. 1 is a schematic view showing a pixel structure according to an embodiment of the present disclosure.

The present disclosure will be described hereinafter in a clear manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

All transistors adopted in the embodiments of the present disclosure may be triodes, TFTs, FETs or any other elements having an identical characteristic. In the embodiments of the present disclosure, in order to differentiate two electrodes of the transistor other than a control electrode from each other, one of the two electrodes is called as first electrode and the other is called as second electrode.

In actual use, when the transistor is a triode, the control electrode may be a base, the first electrode may be a collector and the second electrode may be an emitter, or the control electrode may be a base, the first electrode may be an emitter and the second electrode may be a collector.

In actual use, when the transistor is a TFT or FET, the control electrode may be a gate electrode, the first electrode may be a drain electrode and the second electrode may be a source electrode, or the control electrode may be a gate electrode, the first electrode may be a source electrode and the second electrode may be a drain electrode.

The present disclosure provides in some embodiments a pixel structure, which includes a plurality of gate lines arranged in rows, a plurality of data lines arranged in columns, and a plurality of subpixel circuits arranged in an array form. Each subpixel circuit includes a subpixel and a switching element, the subpixel is electrically connected to one of the data lines via the switching element, a control electrode of the switching element is electrically connected to one of the gate lines, the switching element is configured to control to charge the subpixel through a data voltage on the data line under the control of a gate driving signal on the gate line, and the subpixels electrically connected to a same data line are in a same color.

According to the pixel structure in the embodiments of the present disclosure, the subpixels electrically connected to the same data lie may be in a same color, so no color contamination may occur when two gate lines are turned on simultaneously to increase a refresh rate and a charging time of the subpixel circuit is doubled. In addition, when dot inversion is performed on the pixel structure, the subpixel circuits in a same color may be turned on in same polarity, so the subpixel circuits in the same color in each row may be pre-charged, and thereby such problems as fine pitch and horizontal stripes may not occur.

In the embodiments of the present disclosure, the subpixels electrically connected to the same data line refer to subpixels connected to the same data line through corresponding switching elements, i.e., subpixels in subpixel circuits electrically connected to the same data line.

During the implementation, the control electrodes of the switching elements of the subpixel circuits in a same row may be electrically connected to the same gate line. A subpixel circuit in a $(2n-1)^{th}$ row and an $m^{th}$ column may be electrically connected to an $m^{th}$ first gate line, and a subpixel in a $(2n)^{th}$ row and the $m^{th}$ column may be electrically connected to an $m^{th}$ second data line. The $m^{th}$ first data line may be a data line in the $m^{th}$ column and the $m^{th}$ second data line may be an data line in the $(m+1)^{th}$ column, or the $m^{th}$ first data line may be the data line in the $(m+1)^{th}$ column and the $m^{th}$ second data line may be the data line in the $m^{th}$ column, where m and n are both positive integers.

In the embodiments of the present disclosure, through Z-like architecture, it is able to achieve the dot inversion. The Z-like architecture refers to a situation where the subpixel circuit in the $(2n-1)^{th}$ row and the $m^{th}$ column is electrically connected to the $m^{th}$ first data line, and the subpixel circuit in the $(2n)^{th}$ row and the $m^{th}$ column is electrically connected to the $m^{th}$ second data line, i.e., for the subpixel circuits in a same column, the subpixel circuits in odd-numbered rows are electrically connected to a data line different from the subpixel circuits in even-numbered rows. The $m^{th}$ first data line may be, but not limited to, adjacent to the $m^{th}$ second data line.

In addition, when the Z-like architecture is adopted to achieve the dot inversion, within one frame, data voltages applied to the subpixel circuits connected to a same data line and in a same color may have same polarity. In this way, it is able to pre-charge the subpixel circuits in the same color in each row, and prevent the occurrence of fine pitch and horizontal stripes.

In a possible embodiment of the present disclosure, the subpixel circuit in the $(2n-1)^{th}$ row and the $m^{th}$ column may include a subpixel in a $(2n-1)^{th}$ row and an $m^{th}$ column and a switching element in a $(2n-1)^{th}$ row and an $m^{th}$ column, a control electrode of the switching element in the $(2n-1)^{th}$ row and the $m^{th}$ column may be electrically connected to a gate line in the $(2n-1)^{th}$ row, a first electrode of the switching element in the $(2n-1)^{th}$ row and the $m^{th}$ column may be electrically connected to the $m^{th}$ first data line, and a second electrode of the switch element in the $(2n-1)^{th}$ row and the $m^{th}$ column may be electrically connected to the subpixel in the $(2n-1)^{th}$ row and the $m^{th}$ column. The subpixel circuit in the $(2n)^{th}$ row and the $m^{th}$ column may include a subpixel in a $(2n)^{th}$ row and an $m^{th}$ column and a switching element in a $(2n)^{th}$ row and an $m^{th}$ column, a control electrode of the switching element in the $(2n)^{th}$ row and the $m^{th}$ column may be electrically connected to a gate line in the $(2n)^{th}$ row, a first electrode of the switching element in the $(2n)^{th}$ row and the $m^{th}$ column may be electrically connected to the $m^{th}$ second data line, and a second electrode of the switch element in the $(2n)^{th}$ row and the $m^{th}$ column may be electrically connected to the subpixel in the $(2n)^{th}$ row and the $m^{th}$ column. The $m^{th}$ first data line may be an data line in the $m^{th}$ column and the $m^{th}$ second data line may be an data line in the $(m+1)^{th}$ column, or the $m^{th}$ first data line may be the data line in the $(m+1)^{th}$ column and the $m^{th}$ second data line may be the data line in the $m^{th}$ column, where m and n are both positive integers.

During the implementation, each subpixel circuit may include a subpixel and a switching element, and the switching element may be, but not limited to, a switching transistor.

In the embodiments of the present disclosure, the subpixel in the $(2n-1)^{th}$ row and the $m^{th}$ column may be electrically connected to the $m^{th}$ first data line through the switching element in the $(2n-1)^{th}$ row and the $m^{th}$ column, and the subpixel circuit in the $(2n)^{th}$ row and the $m^{th}$ column may be electrically connected to the $m^{th}$ second data line through the switching element in the $(2n)^{th}$ row and the $m^{th}$ column, i.e., for the subpixel circuits in a same column, the subpixel circuits in odd-numbered rows may be electrically connected to a data line different from the subpixel circuits in even-numbered rows to form a Z-like structure.

As shown in FIG. 1, a subpixel circuit in the $(2n-1)^{th}$ row and a first column includes a subpixel P11 in the $(2n-1)^{th}$ row and the first column and a switching transistor T11 in the $(2n-1)^{th}$ row and the first column, a subpixel circuit in the $(2n)^{th}$ row and the first column includes a subpixel P21 in the $(2n)^{th}$ row and the first column and a switching transistor T21 in the $(2n)^{th}$ row and the first column, a subpixel circuit in the $(2n+1)^{th}$ row and the first column includes a subpixel P31 in the $(2n+1)^{th}$ row and the first column and a switching transistor T31 in the $(2n+1)^{th}$ row and the first column, a subpixel circuit in the $(2n+2)^{th}$ row and the first column includes a subpixel P41 in the $(2n+2)^{th}$ row and the first column and a switching transistor T41 in the $(2n+2)^{th}$ row and the first column, a subpixel circuit in the $(2n-1)^{th}$ row and a second column includes a subpixel P12 in the $(2n-1)^{th}$ row and the second column and a switching transistor T12 in the $(2n-1)^{th}$ row and the second column, a subpixel circuit in the $(2n)^{th}$ row and the second column includes a subpixel P22 in the $(2n)^{th}$ row and the second column and a switching transistor T22 in the $(2n)^{th}$ row and the second column, a subpixel circuit in the $(2n+1)^{th}$ row and the second column includes a subpixel P32 in the $(2n+1)^{th}$ row and the second column and a switching transistor T32 in the $(2n+1)^{th}$ row and the second column, a subpixel circuit in the $(2n+2)^{th}$ row and the second column includes a subpixel P42 in the $(2n+2)^{th}$ row and the second column and a switching transistor T42 in the $(2n+2)^{th}$ row and the second column, a subpixel circuit in the $(2n-1)^{th}$ row and a third column includes a subpixel P13 in the $(2n-1)^{th}$ row and the third column and a switching transistor T13 in the $(2n-1)^{th}$ row and the third column, a subpixel circuit in the $(2n)^{th}$ row and the third column includes a subpixel P23 in the $(2n)^{th}$ row and the third column and a switching transistor T23 in the $(2n)^{th}$ row and the third column, a subpixel circuit in the $(2n+1)^{th}$ row and the third column includes a subpixel P33 in the $(2n+1)^{th}$ row and the third column and a switching transistor T33 in the $(2n+1)^{th}$ row and the third column, and a subpixel circuit in the $(2n+2)^{th}$ row and the third column includes a subpixel P43 in the $(2n+2)^{th}$ row and the third column and a switching transistor T43 in the $(2n+2)^{th}$ row and the third column, where n is a positive integer.

In FIG. 1, a gate electrode of T11, a gate electrode of T12 and a gate electrode of T13 are electrically connected to a gate line G2n−1 in the $(2n-1)^{th}$ row, a gate electrode of T21, a gate electrode of T22 and a gate electrode of T23 are electrically connected to a gate line G2n in the $(2n)^{th}$ row, a gate electrode of T31, a gate electrode of T32 and a gate electrode of T33 are electrically connected to a gate line G2n+1 in the $(2n+1)^{th}$ row, and a gate electrode of T41, a gate electrode of T42 and a gate electrode of T43 are electrically connected to a gate line G2n+2 in the $(2n+2)^{th}$ row.

In FIG. 1, P11, P23, P31 and P43 are blue subpixels, P12, P21, P32 and P41 are green subpixels, and P13, P22, P33 and P42 are red subpixels. A source electrode of T11 is electrically connected to a data line D1 in the first column, and a drain electrode of T11 is electrically connected to P11; a source electrode of T12 is electrically connected to a data line D2 in the second column, and a drain electrode of T12 is electrically connected to P12; a source electrode of T13 is electrically connected to a data line D3 in the third column, and a drain electrode of T13 is electrically connected to P13; a source electrode of T21 is electrically connected to the data line D2 in the second column, and a drain electrode of T21 is electrically connected to P21; a source electrode of T22 is electrically connected to the data line D3 in the third column, and a drain electrode of T22 is electrically connected to P22; a source electrode of T23 is electrically connected to a data line D4 in the fourth column, and a drain electrode of T23 is electrically connected to P23; a source electrode of T31 is electrically connected to the data line D1 in the first column, and a drain electrode of T31 is electrically connected to P31; a source electrode of T32 is electrically connected to the data line D2 in the second column, and a drain electrode of T32 is electrically connected to P32; a source electrode of T33 is electrically connected to the data line D3 in the third column, and a drain electrode of T33 is electrically connected to P33; a source electrode of T41 is electrically connected to the data line D2 in the second column, and a drain electrode of T41 is electrically connected to P41; a source electrode of T42 is electrically connected to the data line D3 in the third column, and a drain electrode of T42 is electrically connected to P42; and a source electrode of T43 is electrically connected to the data line D4 in the fourth column, and a drain electrode of T43 is electrically connected to P43.

In FIG. 1, D1 may be electrically connected to T11 and T31, and T11 and T31 may be connected to blue subpixels respectively; D2 may be electrically connected to T12, T21, T32 and T41, and T12, T21, T32 and T41 may be connected to green subpixels respectively; D3 may be electrically connected to T13, T22, T33 and T42, and T13, T22, T33 and T42 may be connected to red subpixels respectively; D4 may be electrically connected to T23 and T43, and T23 and T43 may be connected to blue subpixels respectively.

In FIG. 1, the pixel structure may be of a Z-like structure, and the pixels may be arranged in the form of islands, so that the subpixels connected to a same data line may be in a same color.

In FIG. 1, all the switching transistors may be, but not limited to, n-type TFTs.

During the operation of the pixel structure in FIG. 1, two gate lines may be turned on simultaneously, so as to double the charging time of the subpixel circuit and simultaneously charge two rows of subpixel circuits, thereby to improve the refresh rate, e.g., from 60 Hz to 120 Hz.

When two gate lines are turned on simultaneously, the switching transistors in the two rows of subpixel circuits may be turned on, and at this time, no color contamination may occur because the subpixels connected to the same data line are in a same color.

In addition, for the pixel structure in FIG. 1, during the dot inversion, for example, within one frame, data voltages applied by corresponding data lines to P11, P13, P22, P31, P33 and P42 may be positive data voltages, and data voltages applied by corresponding data lines to P12, P21, P23, P32, P41 and P43 may be negative voltages. Within one frame, the data voltage applied by D1 to P11 (P11 is electrically connected to D1 via T11) and the data voltage applied by D1 to P31 (P31 is electrically connected to D1 via T31) may each be a positive data voltage; the data voltage applied by D2 to P12 (P12 is electrically connected to D2 via T12), the data voltage applied by D2 to P21 (P21 is electrically connected to D2 via T21), the data voltage applied by D2 to P32 (P32 is electrically connected to D2 via T32) and the data voltage applied by D2 to P41 (P41 is electrically connected to D2 via T41) may each be a negative data voltage; the data voltage applied by D3 to P13 (P13 is electrically connected to D3 via T13), the data voltage applied by D3 to P22 (P22 is electrically connected to D3 via T22), the data voltage applied by D3 to P33 (P33 is electrically connected to D3 via T33), the data voltage applied by D3 to P42 (P42 is electrically connected to D3 via T42), the data voltage applied by D4 to P23 (P23 is electrically connected to D4 via T23) and the data voltage applied by D4 to P43 (P43 is electrically connected to D4 via T43) may each be a negative data voltage. Hence, each subpixel may be pre-charged through the data voltage with same polarity written into a corresponding data line when the gate lines are turned on previously, so as to prevent the occurrence of the fine pitch and the horizontal stripes.

During the operation of the pixel structure in FIG. 1, a time for turning on the gate line may be set as being slightly greater than 2H, and the charging time of the subpixel circuits in one row through the data voltage on the corresponding data line may be set as 2H. However, the present disclosure shall not be limited thereto.

2H represents a time for two gate lines. For example, for a 4K display product with a refresh rate of 60 Hz (the 4K display product includes gate lines in 2160 rows), 1H=1s/60/2160=7.7 μs, so 2H=2s/60/2160=15.4 μs.

Figure 2:
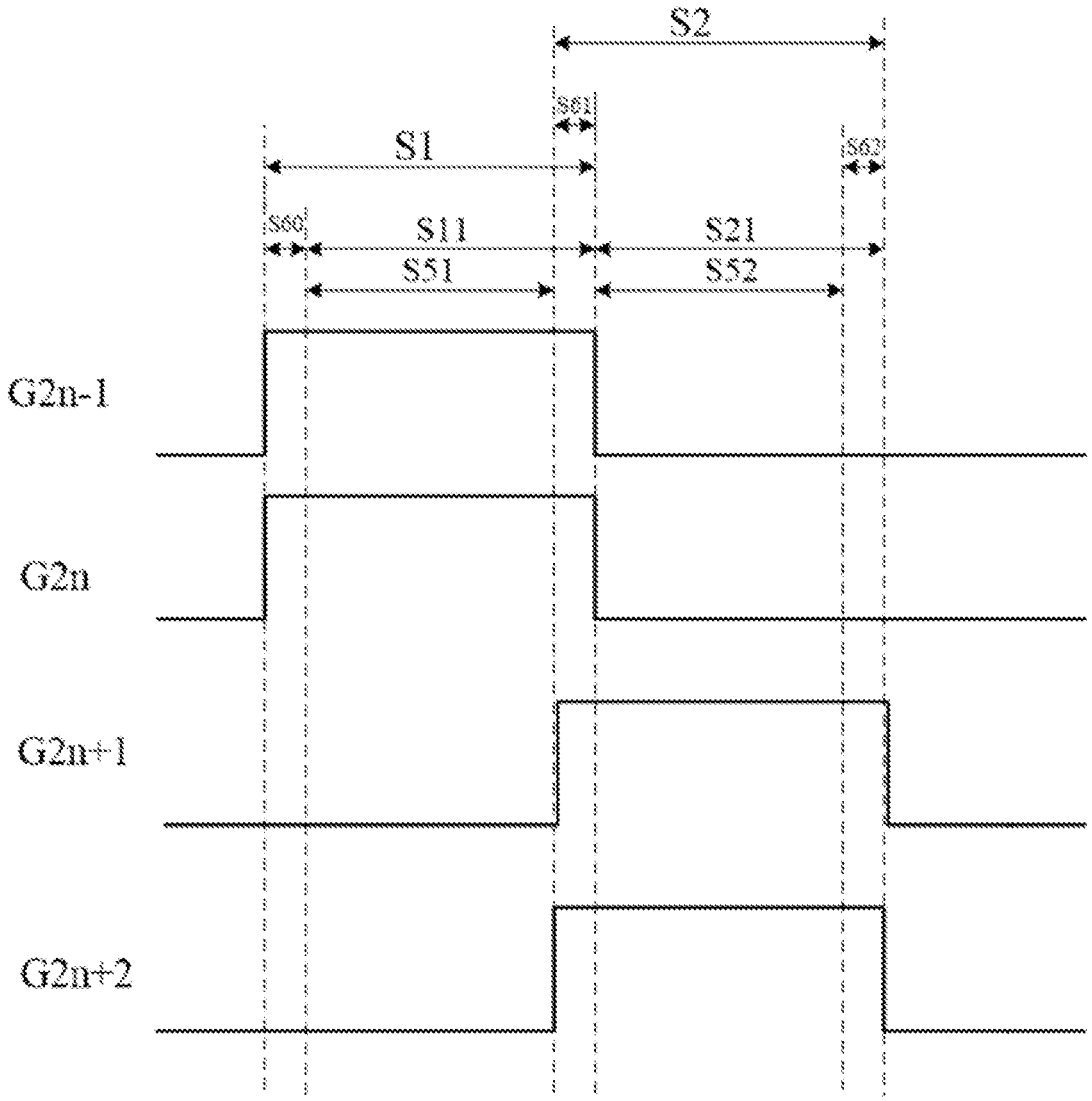
FIG. 2 is a sequence diagram of the pixel structure in FIG. 1.

As shown in FIG. 2, at a first stage S1, G2n−1 and G2n output a high voltage simultaneously, i.e., G2n−1 and G2n are turned on simultaneously. Within a first charging time period S11 of S1, D1 provides a first data voltage, D2 provides a second data voltage, D3 provides a third data voltage and D4 provides a fourth data voltage.

At a second stage S2, G2n+1 and G2n+2 output a high voltage simultaneously, i.e., G2n+1 and G2n+2 are turned on simultaneously. Within a second charging time period S21 of S2, D1 provides a fifth data voltage, D2 provides a sixth data voltage, D3 provides a seventh data voltage and D4 provides an eighth data voltage.

S1 and S2 may be contained within a same frame. Within the same frame, the first data voltage, the third data voltage, the fifth data voltage and the seventh data voltage may have same polarity, and the second data voltage, the fourth data voltage, the sixth data voltage and the eighth data voltage may have same polarity. The first data voltage may have polarity opposite to the second data voltage.

S1 may partially overlap S2. Within a time period where S1 overlaps S2, P31 may be pre-charged through the first data voltage provided by D1, P32 and P41 may be pre-charged through the second data voltage provided by D2, P33 and P42 may be pre-charged through the third data voltage provided by D3, and P43 may be pre-charged through the fourth data voltage provided by D4. Within the time period where S1 overlaps S2, the subpixel circuits electrically connected to G2n+1 and the subpixel circuits electrically connected to G2n+2 may be pre-charged, the first data voltage may have polarity identical to the fifth data voltage applied by D1 to P31 within S21, the second data voltage may have polarity identical to the sixth data voltage applied by D2 to P32 within S21, the second data voltage may have polarity identical to the sixth data voltage applied by D2 to P41 within S21, the third data voltage may have polarity identical to the seventh data voltage applied by D3 to P33 within S21, the third data voltage may have polarity identical to the seventh data voltage applied by D3 to P42 within S21, and the fourth data voltage may have polarity identical to the eighth data voltage applied by D4 to P43 within S21. Hence, it is able to further prevent the occurrence of fine pitch and horizontal stripes.

In FIG. 2, within a time period of S1 other than S11 (i.e., a short time period at the very beginning of S1, the time period of S1 other than S11 may be an $(n-1)^{th}$ pre-charging state S60), each data line may provide a data voltage as that provided when the gate lines in the previous two rows are turned on (the gate lines in the previous two rows refer to two gate lines before G2n−1, e.g., when G2n−1 is a gate line in the seventh row, the gate lines in the previous two rows may be gate lines in the fifth and sixth rows).

In FIG. 2, a time period S61 where S1 overlaps S2 may be an $n^{th}$ pre-charging stage, and a time period of S11 other than S61 may be an $n^{th}$ display stage S51.

In FIG. 2, S62 represents an $(n+1)^{th}$ pre-charging stage, and a time period of S21 other than S62 may be an $(n+1)^{th}$ display stage S52.

Figure 3:
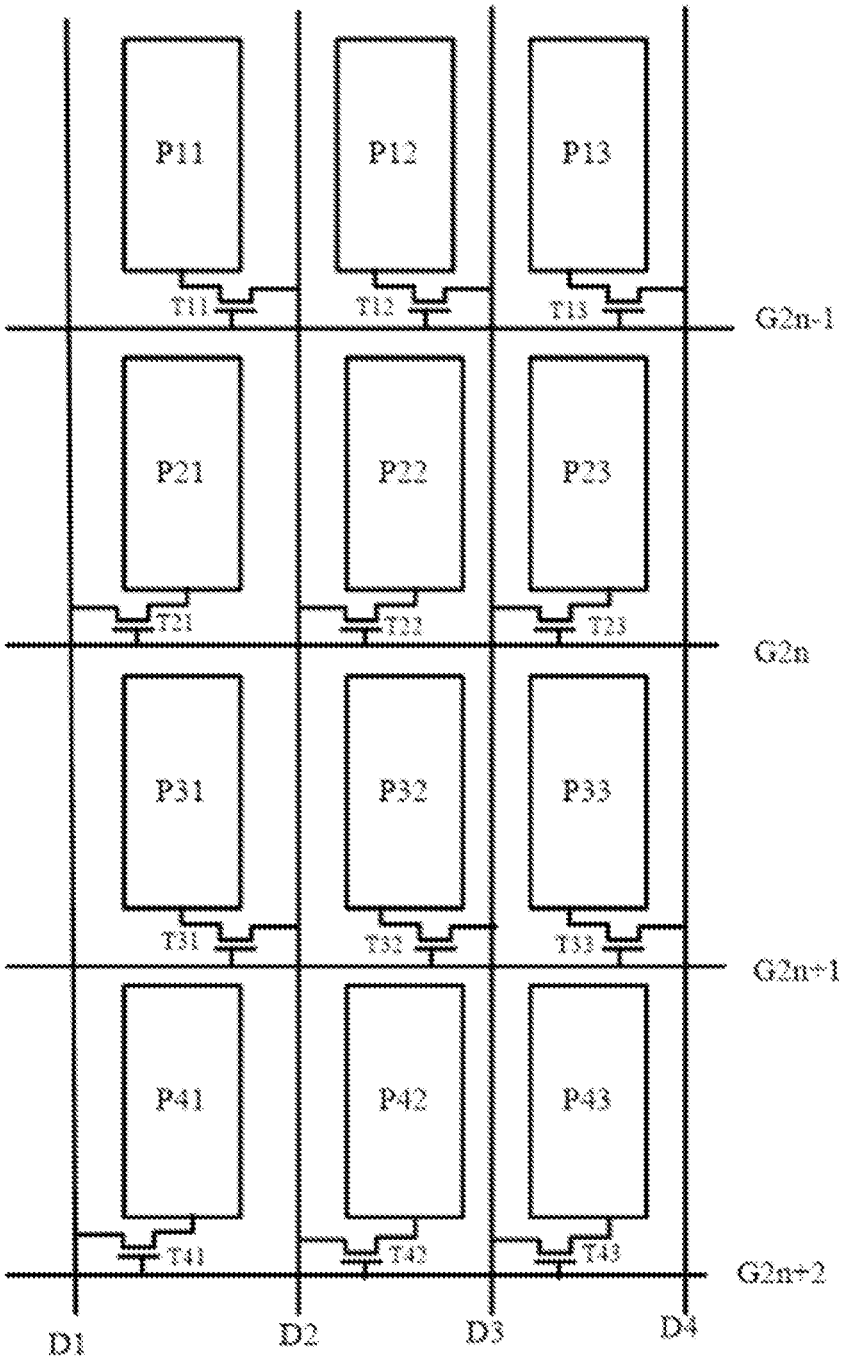
FIG. 3 is another schematic view showing the pixel structure according to an embodiment of the present disclosure.

As shown in FIG. 3, a subpixel circuit in the $(2n-1)^{th}$ row and a first column includes a subpixel P11 in the $(2n-1)^{th}$ row and the first column and a switching transistor T11 in the $(2n-1)^{th}$ row and the first column, a subpixel circuit in the $(2n)^{th}$ row and the first column includes a subpixel P21 in the $(2n)^{th}$ row and the first column and a switching transistor T21 in the $(2n)^{th}$ row and the first column, a subpixel circuit in the $(2n+1)^{th}$ row and the first column includes a subpixel P31 in the $(2n+1)^{th}$ row and the first column and a switching transistor T31 in the $(2n+1)^{th}$ row and the first column, a subpixel circuit in the $(2n+2)^{th}$ row and the first column includes a subpixel P41 in the $(2n+2)^{th}$ row and the first column and a switching transistor T41 in the $(2n+2)^{th}$ row and the first column, a subpixel circuit in the $(2n-1)^{th}$ row and a second column includes a subpixel P12 in the $(2n-1)^{th}$ row and the second column and a switching transistor T12 in the $(2n-1)^{th}$ row and the second column, a subpixel circuit in the $(2n)^{th}$ row and the second column includes a subpixel P22 in the $(2n)^{th}$ row and the second column and a switching transistor T22 in the $(2n)^{th}$ row and the second column, a subpixel circuit in the $(2n+1)^{th}$ row and the second column includes a subpixel P32 in the $(2n+1)^{th}$ row and the second column and a switching transistor T32 in the $(2n+1)^{th}$ row and the second column, a subpixel circuit in the $(2n+2)^{th}$ row and the second column includes a subpixel P42 in the $(2n+2)^{th}$ row and the second column and a switching transistor T42 in the $(2n+2)^{th}$ row and the second column, a subpixel circuit in the $(2n-1)^{th}$ row and a third column includes a subpixel P13 in the $(2n-1)^{th}$ row and the third column and a switching transistor T13 in the $(2n-1)^{th}$ row and the third column, a subpixel circuit in the $(2n)^{th}$ row and the third column includes a subpixel P23 in the $(2n)^{th}$ row and the third column and a switching transistor T23 in the $(2n)^{th}$ row and the third column, a subpixel circuit in the $(2n+1)^{th}$ row and the third column includes a subpixel P33 in the $(2n+1)^{th}$ row and the third column and a switching transistor T33 in the $(2n+1)^{th}$ row and the third column, and a subpixel circuit in the $(2n+2)^{th}$ row and the third column includes a subpixel P43 in the $(2n+2)^{th}$ row and the third column and a switching transistor T43 in the $(2n+2)^{th}$ row and the third column, where n is a positive integer.

In FIG. 3, a gate electrode of T11, a gate electrode of T12 and a gate electrode of T13 are electrically connected to a gate line G2n−1 in the $(2n-1)^{th}$ row, a gate electrode of T21, a gate electrode of T22 and a gate electrode of T23 are electrically connected to a gate line G2n in the $(2n)^{th}$ row, a gate electrode of T31, a gate electrode of T32 and a gate electrode of T33 are electrically connected to a gate line G2n+1 in the $(2n+1)^{th}$ row, and a gate electrode of T41, a gate electrode of T42 and a gate electrode of T43 are electrically connected to a gate line G2n+2 in the $(2n+2)^{th}$ row.

In FIG. 3, P11, P22, P31 and P42 are red subpixels, P12, P23, P32 and P43 are green subpixels, and P13, P21, P33 and P41 are blue subpixels. A source electrode of T11 is electrically connected to a data line D2 in the second column, and a drain electrode of T11 is electrically connected to P11; a source electrode of T12 is electrically connected to a data line D3 in the third column, and a drain electrode of T12 is electrically connected to P12; a source electrode of T13 is electrically connected to a data line D4 in the fourth column, and a drain electrode of T13 is electrically connected to P13; a source electrode of T21 is electrically connected to a data line D1 in the first column, and a drain electrode of T21 is electrically connected to P21; a source electrode of T22 is electrically connected to the data line D2 in the second column, and a drain electrode of T22 is electrically connected to P22; a source electrode of T23 is electrically connected to the data line D3 in the third column, and a drain electrode of T23 is electrically connected to P23; a source electrode of T31 is electrically connected to the data line D2 in the second column, and a drain electrode of T31 is electrically connected to P31; a source electrode of T32 is electrically connected to the data line D3 in the third column, and a drain electrode of T32 is electrically connected to P32; a source electrode of T33 is electrically connected to the data line D4 in the fourth column, and a drain electrode of T33 is electrically connected to P33; a source electrode of T41 is electrically connected to the data line D1 in the first column, and a drain electrode of T41 is electrically connected to P41; a source electrode of T42 is electrically connected to the data line D2 in the second column, and a drain electrode of T42 is electrically connected to P42; and a source electrode of T43 is electrically connected to the data line D3 in the third column, and a drain electrode of T43 is electrically connected to P43.

In FIG. 3, D1 may be electrically connected to T21 and T41, and T21 and T41 may be connected to blue subpixels respectively; D2 may be electrically connected to T11, T22, T31 and T42, and T11, T22, T31 and T42 may be connected to red subpixels respectively; D3 may be electrically connected to T12, T23, T32 and T43, and T12, T23, T32 and T43 may be connected to green subpixels respectively; D4 may be electrically connected to T13 and T33, and T13 and T33 may be connected to blue subpixels respectively.

In FIG. 3, the pixel structure may be of a Z-like structure, and the pixels may be arranged in the form of islands, so that the subpixels connected to a same data line may be in a same color.

In FIG. 3, all the switching transistors may be, but not limited to, n-type TFTs.

During the operation of the pixel structure in FIG. 3, two gate lines may be turned on simultaneously, so as to double the charging time of the subpixel circuit and simultaneously charge two rows of subpixel circuits, thereby to improve the refresh rate, e.g., from 60 Hz to 120 Hz.

When two gate lines are turned on simultaneously, the switching transistors in the two rows of subpixel circuits may be turned on, and at this time, no color contamination may occur because the subpixels connected to the same data line are in a same color.

In addition, for the pixel structure in FIG. 3, during the dot inversion, for example, within one frame, data voltages applied by corresponding data lines to P11, P13, P22, P31, P33 and P42 may be positive data voltages, and data voltages applied by corresponding data lines to P12, P21, P23, P32, P41 and P43 may be negative voltages. Within one frame, the data voltage applied by D1 to P21 (P21 is electrically connected to D1 via T21) and the data voltage applied by D1 to P41 (P41 is electrically connected to D1 via T41) may each be a negative data voltage; the data voltage applied by D2 to P11 (P11 is electrically connected to D2 via T11), the data voltage applied by D2 to P22 (P22 is electrically connected to D2 via T22), the data voltage applied by D2 to P31 (P31 is electrically connected to D2 via T31) and the data voltage applied by D2 to P42 (P42 is electrically connected to D2 via T42) may each be a positive data voltage; the data voltage applied by D3 to P12 (P12 is electrically connected to D3 via T12), the data voltage applied by D3 to P23 (P23 is electrically connected to D3 via T23), the data voltage applied by D3 to P32 (P32 is electrically connected to D3 via T32), and the data voltage applied by D3 to P43 (P43 is electrically connected to D3 via T43) may each be a negative data voltage; the data voltage applied by D4 to P13 (P13 is electrically connected to D4 via T13) and the data voltage applied by D4 to P33 (P33 is electrically connected to D4 via T33) may each be a positive data voltage. Hence, each subpixel may be pre-charged through the data voltage with same polarity written into a corresponding data line when the gate lines are turned on previously, so as to prevent the occurrence of the fine pitch and the horizontal stripes.

During the operation of the pixel structure in FIG. 3, a time for turning on the gate line may be set as being slightly greater than 2H, and the charging time of the subpixel circuits in one row through the data voltage on the corresponding data line may be set as 2H. However, the present disclosure shall not be limited thereto.

Figure 4:
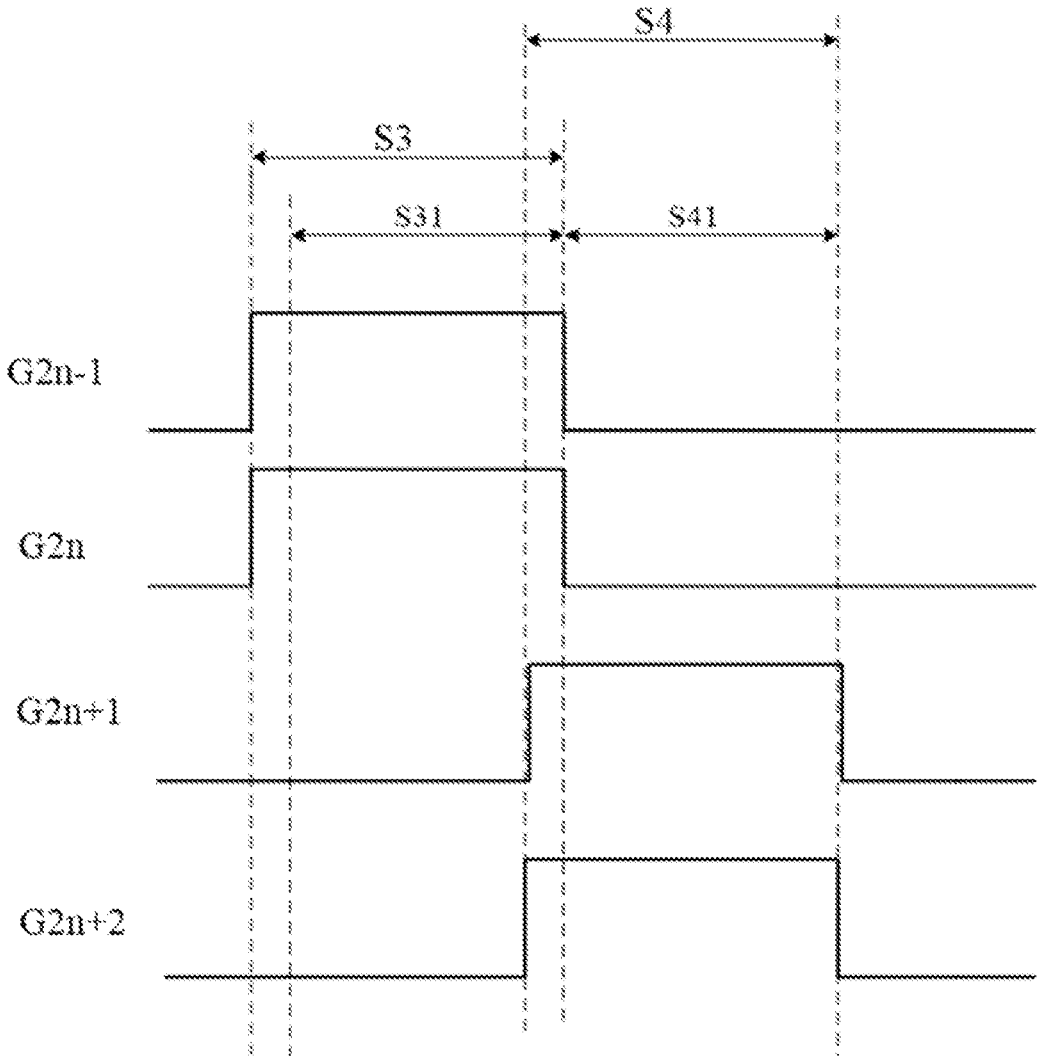
FIG. 4 is a sequence diagram of the pixel structure in FIG. 3.

As shown in FIG. 4, at a third stage S3, G2n−1 and G2n output high voltages simultaneously, i.e., G2n−1 and G2n are turned on simultaneously. Within a third charging time period S31 of S3, D1 provides a first data voltage, D2 provides a second data voltage, D3 provides a third data voltage and D4 provides a fourth data voltage.

At a fourth stage S4, G2n+1 and G2n+2 output a high voltage simultaneously, i.e., G2n+1 and G2n+2 are turned on simultaneously. Within a fourth charging time period S41 of S4, D1 provides a fifth data voltage, D2 provides a sixth data voltage, D3 provides a seventh data voltage and D4 provides an eighth data voltage.

S3 and S4 may be contained within a same frame. Within a same frame, the first data voltage, the third data voltage, the fifth data voltage and the seventh data voltage may have same polarity, and the second data voltage, the fourth data voltage, the sixth data voltage and the eighth data voltage may have same polarity. The first data voltage may have polarity opposite to the second data voltage.

S3 may partially overlap S4. Within a time period where S3 overlaps S4, P41 may be pre-charged through the first data voltage provided by D1, P31 and P42 may be pre-charged through the second data voltage provided by D2, P32 and P43 may be pre-charged through the third data voltage provided by D3, and P33 may be pre-charged through the fourth data voltage provided by D4. Within the time period where S3 overlaps S4, the subpixel circuits electrically connected to G2n+1 and the subpixel circuits electrically connected to G2n+2 may be pre-charged, the first data voltage may have polarity identical to the fifth data voltage applied by D1 to P41 within S41, the second data voltage may have polarity identical to the sixth data voltage applied by D2 to P31 within S41, the second data voltage may have polarity identical to the sixth data voltage applied by D2 to P42 within S41, the third data voltage may have polarity identical to the seventh data voltage applied by D3 to P32 within S41, the third data voltage may have polarity identical to the seventh data voltage applied by D3 to P43 within S41, and the fourth data voltage may have polarity identical to the eighth data voltage applied by D4 to P33 within S41. Hence, it is able to further prevent the occurrence of fine pitch.

In FIG. 4, within a time period of S3 other than S31 (i.e., a short time period at the very beginning of S3), each data line may provide a data voltage as that provided when the gate lines in the previous two rows are turned on (the gate lines in the previous two rows refer to two gate lines before G2n−1, e.g., when G2n−1 is a gate line in a seventh row, the gate lines in the previous two rows may be gate lines in fifth and sixth rows).

FIGS. 1 and 3 merely show the subpixel circuits in four rows and three columns. However, in actual use, the pixel structure may include the subpixel circuits in a plurality of rows and a plurality of columns. The quantity of rows and columns of the subpixel circuits of the pixel structure may be determined in accordance with a size and a resolution of a display panel including the pixel structure.

The present disclosure further provides in some embodiments a driving method for the above-mentioned pixel structure, which includes controlling at least two gate lines to output effective gate driving signals simultaneously, to turn on the switching elements whose control electrodes are electrically connected to the at least two gate lines.

According to the driving method in the embodiments of the present disclosure, at least two gate lines are controlled to simultaneously output the effective gate driving signal so as to control charge at least two rows of subpixel circuits simultaneously. As a result, it is able to increase a charging time, thereby to increase a refresh rate.

In a possible embodiment of the present disclosure, the subpixel circuit in a $(2n-1)^{th}$ row and an $m^{th}$ column may include a subpixel in a $(2n-1)^{th}$ row and an $m^{th}$ column and a switching element in a $(2n-1)^{th}$ row and an $m^{th}$ column, a control electrode of the switching element in the $(2n-1)^{th}$ row and the $m^{th}$ column may be electrically connected to a gate line in the $(2n-1)^{th}$ row, a first electrode of the switching element in the $(2n-1)^{th}$ row and the $m^{th}$ column may be electrically connected to an $m^{th}$ first data line, and a second electrode of the switch element in the $(2n-1)^{th}$ row and the $m^{th}$ column may be electrically connected to the subpixel in the $(2n-1)^{th}$ row and the $m^{th}$ column. The subpixel circuit in a $(2n)^{th}$ row and an $m^{th}$ column may include a subpixel in a $(2n)^{th}$ row and an $m^{th}$ column and a switching element in a $(2n)^{th}$ row and an $m^{th}$ column, a control electrode of the switching element in the $(2n)^{th}$ row and the $m^{th}$ column may be electrically connected to a gate line in the $(2n)^{th}$ row, a first electrode of the switching element in the $(2n)^{th}$ row and the $m^{th}$ column may be electrically connected to an $m^{th}$ second data line, and a second electrode of the switch element in the $(2n)^{th}$ row and the $m^{th}$ column may be electrically connected to the subpixel in the $(2n)^{th}$ row and the $m^{th}$ column. The $m^{th}$ first data line may be an data line in the $m^{th}$ column and the $m^{th}$ second data line may be an data line in the $(m+1)^{th}$ column, or the $m^{th}$ first data line may be the data line in the $(m+1)^{th}$ column and the $m^{th}$ second data line may be the data line in the $m^{th}$ column, where m and n are both positive integers. A display period may include a plurality of display stages, and the driving method may include, at an $n^{th}$ display stage, controlling the gate line in the $(2n-1)^{th}$ row and the gate line in the $(2n)^{th}$ row to output the effective gate driving signals simultaneously to turn on the switching elements whose control electrodes are electrically connected to the gate line in the $(2n-1)^{th}$ row and the switching elements whose control electrodes are electrically connected to the gate line in the $(2n)^{th}$ row, and controlling the data lines to provide corresponding $n^{th}$ data voltages to charge the corresponding subpixels.

In the embodiments of the present disclosure, the display period may be, but not limited to, one frame.

During the implementation, at the $n^{th}$ display stage, the gate line in the $(2n-1)^{th}$ row and the gate line in the $(2n)^{th}$ row may be controlled to output the effective gate driving signals simultaneously, so as to charge the subpixel circuits in the $(2n-1)^{th}$ row and the subpixel circuits in the $(2n)^{th}$ row simultaneously.

In the embodiments of the present disclosure, the switching element may be turned on or off under the control of the gate driving signal. When the switching element is turned on when the gate driving signal is a high voltage signal, the gate driving signal may be effective when it is a high voltage signal, and when the switching element is turned on when the gate driving signal is a low voltage signal, the gate driving signal may be effective when it is a low voltage signal.

In a possible embodiment of the present disclosure, the switching element may be a switching transistor. When the switching transistor is an n-type transistor, the gate driving signal may be effective when it is a high voltage signal, and when the switching transistor is a p-type transistor, the gate driving signal may be effective when it is a low voltage signal.

During the implementation, the display period may further include a pre-charging stage between adjacent display stages, and a pre-charging stage between an $n^{th}$ display stage and an $(n+1)^{th}$ display stage may be an $n^{th}$ pre-charging stage. The driving method may further include, at the $n^{th}$ pre-charging stage, controlling the gate line in the $(2n-1)^{th}$ row, the gate line in the $(2n)^{th}$ row, a gate line in the $(2n+1)^{th}$ row and a gate line in the $(2n+2)^{th}$ row to provide the effective gate driving signals to turn on the switching elements whose control electrodes are electrically connected to the gate line in the $(2n-1)^{th}$ row, the switching elements whose control electrodes are electrically connected to the gate line in the $(2n)^{th}$ row, the switching elements whose control electrodes are electrically connected to the gate line in the $(2n+1)^{th}$ row and the switching elements whose control electrodes are electrically connected to the gate line in the $(2n+2)^{th}$ row, and controlling the data lines to provide the corresponding $n^{th}$ data voltages so as to charge the corresponding subpixels.

In the embodiments of the present disclosure, the $n^{th}$ pre-charging stage may be set between the $n^{th}$ display stage and the $(n+1)^{th}$ display stage. At the $n^{th}$ pre-charging stage, the gate line in the $(2n-1)^{th}$ row, the gate line in the $(2n)^{th}$ row, the gate line in the $(2n+1)^{th}$ row and the gate line in the $(2n+2)^{th}$ row may each provide the effective gate driving signal, and at this time, each data line may provide the corresponding $n^{th}$ data voltage, so as to pre-charge the subpixels in the $(2n+1)^{th}$ row and the subpixels in the $(2n+2)^{th}$ row while charging the subpixels in the $(2n-1)^{th}$ row and the subpixels in the $(2n)^{th}$ row. In addition, when the above-mentioned pixel structure is used to perform the dot inversion, within a same frame, the subpixels connected to the same data line may be in a same color, and the data voltages applied to the subpixels in a same color may have same polarity. As a result, it is able to prevent the occurrence of fine pith and horizontal stripes due to different pre-charging states.

The present disclosure further provides in some embodiments a display device including the above-mentioned pixel structure.

During the implementation, the display device may further include a gate driving circuit and a data driving circuit. The gate driving circuit is configured to control at least two gate lines in the plurality of gate lines to output effective gate driving signals simultaneously, to turn on the switching elements whose control electrodes are electrically connected to the at least two gate lines, and the data driving circuit is configured to provide a corresponding data voltage to the data line.

In a possible embodiment of the present disclosure, the subpixel circuit in a $(2n-1)^{th}$ row and an $m^{th}$ column may include a subpixel in a $(2n-1)^{th}$ row and an $m^{th}$ column and a switching element in a $(2n-1)^{th}$ row and an $m^{th}$ column, a control electrode of the switching element in the $(2n-1)^{th}$ row and the $m^{th}$ column may be electrically connected to a gate line in the $(2n-1)^{th}$ row, a first electrode of the switching element in the $(2n-1)^{th}$ row and the $m^{th}$ column may be electrically connected to an $m^{th}$ first data line, and a second electrode of the switch element in the $(2n-1)^{th}$ row and the $m^{th}$ column may be electrically connected to the subpixel in the $(2n-1)^{th}$ row and the $m^{th}$ column. The subpixel circuit in a $(2n)^{th}$ row and an $m^{th}$ column may include a subpixel in a $(2n)^{th}$ row and an $m^{th}$ column and a switching element in a $(2n)^{th}$ row and an $m^{th}$ column, a control electrode of the switching element in the $(2n)^{th}$ row and the $m^{th}$ column may be electrically connected to a gate line in the $(2n)^{th}$ row, a first electrode of the switching element in the $(2n)^{th}$ row and the $m^{th}$ column may be electrically connected to an $m^{th}$ second data line, and a second electrode of the switch element in the $(2n)^{th}$ row and the $m^{th}$ column may be electrically connected to the subpixel in the $(2n)^{th}$ row and the $m^{th}$ column. The $m^{th}$ first data line may be an data line in the $m^{th}$ column and the $m^{th}$ second data line may be an data line in the $(m+1)^{th}$ column, or the $m^{th}$ first data line may be the data line in the $(m+1)^{th}$ column and the $m^{th}$ second data line may be the data line in the $m^{th}$ column, where m and n are both positive integers. A display period may include a plurality of display stages. The gate driving circuit is configured to, at an $n^{th}$ display stage, control the gate line in the $(2n-1)^{th}$ row and the gate line in the $(2n)^{th}$ row to output the effective gate driving signals simultaneously to turn on the switching elements whose control electrodes are electrically connected to the gate line in the $(2n-1)^{th}$ row and the switching elements whose control electrodes are electrically connected to the gate line in the $(2n)^{th}$ row. The data driving circuit is configured to, at the $n^{th}$ display stage, provide corresponding $n^{th}$ data voltages to the data lines to charge the corresponding subpixels.

Figure 5:
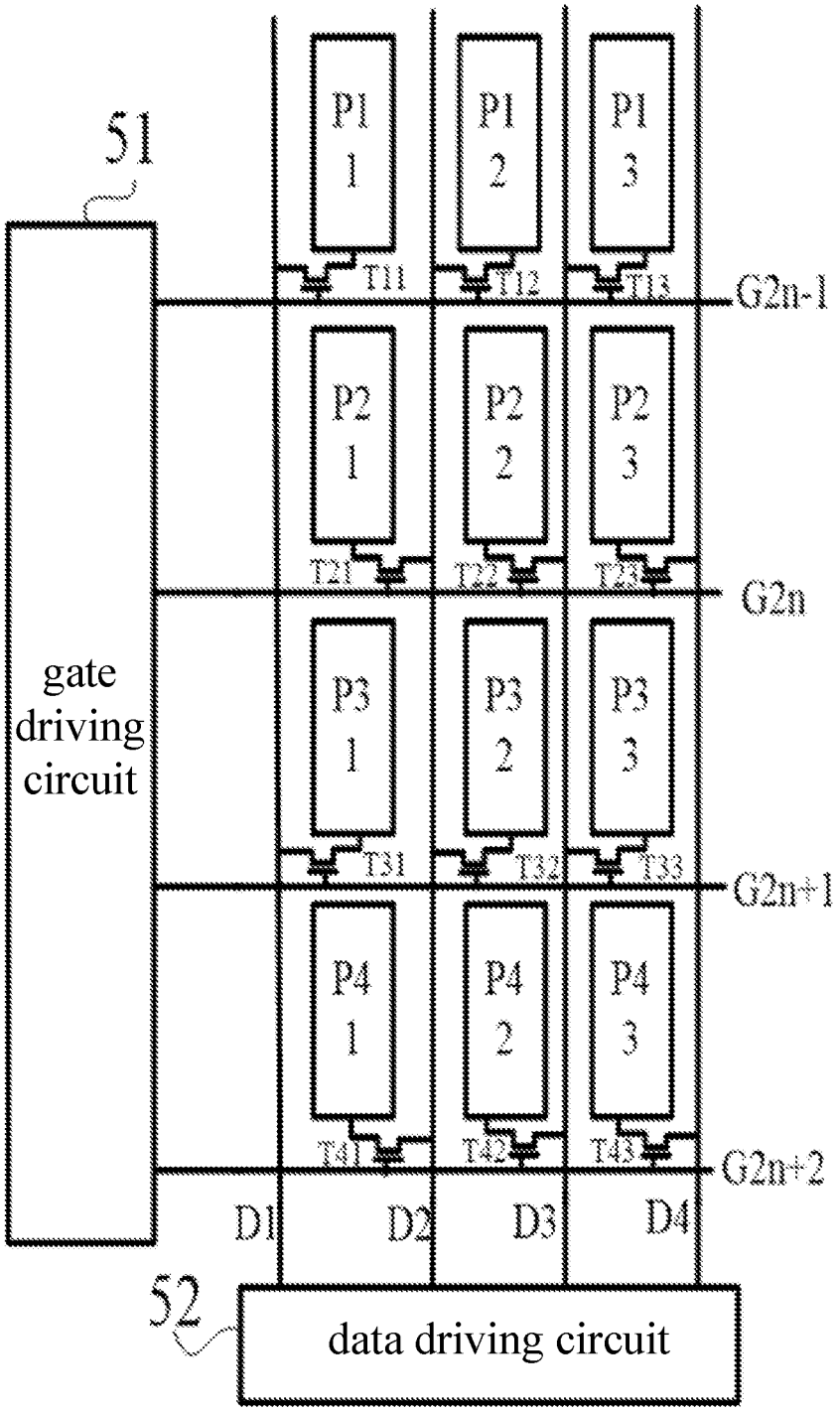
FIG. 5 is a schematic view showing a display device according to an embodiment of the present disclosure.

As shown in FIG. 5, on the basis of the pixel structure in FIG. 1, the display device further includes a gate driving circuit 51 and a data driving circuit 52. The gate driving circuit 51 is electrically connected to a gate line G2n−1 in the $(2n-1)^{th}$ row, a gate line G2n in the $(2n)^{th}$ row, a gate line G2n+1 in the $(2n+1)^{th}$ row and a gate line G2n+2 in the $(2n+2)^{th}$ row, and configured to, at the $n^{th}$ display stage, control the gate line G2n−1 in the $(2n-1)^{th}$ row and the gate line G2n in the $(2n)^{th}$ row to output effective gate driving signals simultaneously to turn on switching elements whose control electrodes are electrically connected to the gate line G2n−1 in the $(2n-1)^{th}$ row and switching elements whose control electrodes are electrically connected to the gate line G2n in the $(2n)^{th}$ row, and at an $(n+1)^{th}$ display stage, control the gate line G2n+1 in the $(2n+1)^{th}$ row and the gate line G2n+2 in the $(2n+2)^{th}$ row to output effective gate driving signals simultaneously to turn on switching elements whose control electrodes are electrically connected to the gate line G2n−1 in the $(2n+1)^{th}$ row and switching elements whose control electrodes are electrically connected to the gate line G2n+2 in the $(2n+2)^{th}$ row.

The data driving circuit is electrically connected to a data line D1 in the first column, a data line D2 in the second column, a data line D3 in the third column and a data line D4 in the fourth column, and configured to, at the $n^{th}$ display stage, provide the corresponding $n^{th}$ data voltages to the data lines to charge the corresponding subpixels, and at the $(n+1)^{th}$ display stage, provide corresponding $(n+1)^{th}$ data voltages to the data lines to charge the corresponding subpixels.

In the embodiments of the present disclosure, the display period may further include a pre-charging stage between adjacent display stages, and a pre-charging stage between an $n^{th}$ display stage and an $(n+1)^{th}$ display stage may be an $n^{th}$ pre-charging stage. The gate driving circuit is configured to, at the $n^{th}$ pre-charging stage, control the gate line in the $(2n-1)^{th}$ row, the gate line in the $(2n)^{th}$ row, the gate line in the $(2n+1)^{th}$ row and the gate line in the $(2n+2)^{th}$ row to provide the effective gate driving signals to turn on the switching elements whose control electrodes are electrically connected to the gate line in the $(2n-1)^{th}$ row, the switching elements whose control electrodes are electrically connected to the gate line in the $(2n)^{th}$ row, the switching elements whose control electrodes are electrically connected to the gate line in the $(2n+1)^{th}$ row and the switching elements whose control electrodes are electrically connected to the gate line in the $(2n+2)^{th}$ row. The data driving circuit is configured to, at the $n^{th}$ pre-charging stage, provide the corresponding $n^{th}$ data voltages to the data lines so as to charge the corresponding subpixels.

In FIG. 5, the gate driving circuit 51 is further configured to, at the $n^{th}$ pre-charging stage, control the gate line G2n−1 in the $(2n-1)^{th}$ row, the gate line G2n in the $(2n)^{th}$ row, the gate line G2n+1 in the $(2n+1)^{th}$ row and the gate line G2n+2 in the $(2n+2)^{th}$ row to provide the effective gate driving signals, to turn on the switching elements whose control electrodes are electrically connected to the gate line G2n−1 in the $(2n-1)^{th}$ row, the switching elements whose control electrodes are electrically connected to the gate line G2n in the $(2n)^{th}$ row, the switching elements whose control electrodes are electrically connected to the gate line G2n+1 in the $(2n+1)^{th}$ row and the switching elements whose control electrodes are electrically connected to the gate line G2n+2 in the $(2n+2)^{th}$ row. The data driving circuit 52 is further configured to, at the $n^{th}$ pre-charging stage, provide the corresponding $n^{th}$ data voltages to the data lines to charge the corresponding subpixels.

In the embodiments of the present disclosure, during the operation of the display device in FIG. 5, at the $n^{th}$ pre-charging stage, the subpixels in the $(2n+1)^{th}$ row and the subpixels in the $(2n+2)^{th}$ row may be charged through the $n^{th}$ data voltage, so as to prevent the occurrence of fine pitch and horizontal stripes.

The display device in the embodiments of the present disclosure may be any product or member having a display function, e.g., mobile phone, tablet computer, television, display, laptop computer, digital photo frame or navigator.

The above embodiments are for illustrative purposes only, but the present disclosure is not limited thereto. It should be noted that a person skilled in the art may make further modifications and improvements without departing from the spirit of the present disclosure, and these modifications and improvements shall also fall within the scope of the present disclosure.

What is claimed is:

1. A pixel structure, comprising a plurality of gate lines arranged in rows, a plurality of data lines arranged in columns, and a plurality of subpixel circuits arranged in an array form, wherein each of the subpixel circuitries comprises a subpixel and a switching element;

the subpixel is electrically connected to one of the data lines via the switching element, a control electrode of the switching element is electrically connected to one of the gate lines;

the subpixels electrically connected to the same data line are in a same color;

the control electrodes of the switching elements of the subpixel circuits in a same row are electrically connected to the same gate line;

in the plurality of subpixel circuits arranged in the array form, a subpixel circuit in a $(2n-1)^{th}$ row and an $m^{th}$ column is electrically connected to an $m^{th}$ first data line, and a subpixel circuit in a $(2n)^{th}$ row and the $m^{th}$ column is electrically connected to an $m^{th}$ second data line; and the $m^{th}$ first data line is a data line in an $m^{th}$ column among the plurality of data lines arranged in the columns, and the $m^{th}$ second data line is a data line in an $m^{th+1}$ column among the plurality of data lines arranged in the columns; or the $m^{th}$ first data line is the data line in the $m^{th+1}$ column among the plurality of data lines arranged in the columns, and the $m^{th}$ second data line is the data line in the $m^{th}$ column among the plurality of data lines arranged in the columns, where m and n are both positive integers.

2. The pixel structure according to claim 1, wherein the switching element is configured to control to charge the subpixel through a data voltage on the data line under control of a gate driving signal on the gate line.

3. The pixel structure according to claim 1, wherein the subpixel circuit in the $(2n-1)^{th}$ row and the $m^{th}$ column comprises a subpixel in a $(2n-1)^{th}$ row and an $m^{th}$ column and a switching element in a $(2n-1)^{th}$ row and an $m^{th}$ column, a control electrode of the switching element in the $(2n-1)^{th}$ row and the $m^{th}$ column is electrically connected to a gate line in a $(2n-1)^{th}$ row, a first electrode of the switching element in the $(2n-1)^{th}$ row and the $m^{th}$ column is electrically connected to the $m^{th}$ first data line, and a second electrode of the switch element in the $(2n-1)^{th}$ row and the $m^{th}$ column is electrically connected to the subpixel in the $(2n-1)^{th}$ row and the $m^{th}$ column;

the subpixel circuit in the $(2n)^{th}$ row and the $m^{th}$ column comprises a subpixel in a $(2n)^{th}$ row and an $m^{th}$ column and a switching element in a $(2n)^{th}$ row and an $m^{th}$ column, a control electrode of the switching element in the $(2n)^{th}$ row and the $m^{th}$ column is electrically connected to a gate line in the $(2n)^{th}$ row, a first electrode of the switching element in the $(2n)^{th}$ row and the $m^{th}$ column is electrically connected to the $m^{th}$ second data line, and a second electrode of the switch element in the $(2n)^{th}$ row and the $m^{th}$ column is electrically connected to the subpixel in the $(2n)^{th}$ row and the $m^{th}$ column.

4. The pixel structure according to claim 1, wherein the switching element is a triode, a Thin Film Transistor (TFT) or a Field Effect Transistor (FET).

5. The pixel structure according to claim 4, wherein the switching element further comprises a first electrode and a second electrode, the subpixel is connected to the first electrode of the switching element, and the data line is connected to the second electrode of the switching element.

6. A driving method for the pixel structure according to claim 1, comprising:

controlling at least two gate lines in the plurality of gate lines to output effective gate driving signals simultaneously, to turn on the switching elements whose control electrodes are electrically connected to the at least two gate lines.

7. The driving method according to claim 6, wherein in the plurality of subpixel circuits arranged in the array form, a subpixel circuit in a $(2n-1)^{th}$ row and an $m^{th}$ column comprises a subpixel in a $(2n-1)^{th}$ row and an $m^{th}$ column and a switching element in a $(2n-1)^{th}$ row and an $m^{th}$ column, a control electrode of the switching element in the $(2n-1)^{th}$ row and the $m^{th}$ column is electrically connected to a gate line in a $(2n-1)^{th}$ row, a first electrode of the switching element in the $(2n-1)^{th}$ row and the $m^{th}$ column is electrically connected to an $m^{th}$ first data line, and a second electrode of the switch element in the $(2n-1)^{th}$ row and the $m^{th}$ column is electrically connected to the subpixel in the $(2n-1)^{th}$ row and the $m^{th}$ column; a subpixel circuit in a $(2n)^{th}$ row and an $m^{th}$ column comprises a subpixel in a $(2n)^{th}$ row and an $m^{th}$ column and a switching element in a $(2n)^{th}$ row and an $m^{th}$ column, a control electrode of the switching element in the $(2n)^{th}$ row and the $m^{th}$ column is electrically connected to a gate line in the $(2n)^{th}$ row, a first electrode of the switching element in the $(2n)^{th}$ row and the $m^{th}$ column is electrically connected to the $m^{th}$ second data line, and a second electrode of the switch element in the $(2n)^{th}$ row and the $m^{th}$ column is electrically connected to the subpixel in the $(2n)^{th}$ row and the $m^{th}$ column; the $m^{th}$ first data line is a data line in an $m^{th}$ column among the plurality of data lines arranged in the columns, and the $m^{th}$ second data line is a data line in an $m^{th+1}$ column among the plurality of data lines arranged in the columns; or the $m^{th}$ first data line is the data line in the $m^{th+1}$ column among the plurality of data lines arranged in the columns, and the $m^{th}$ second data line is the data line in the $m^{th}$ column among the plurality of data lines arranged in the columns, where m and n are both positive integers;

a display period comprises a plurality of display stages, and the driving method comprises:

at an $n^{th}$ display stage among the display stages, controlling the gate line in the $(2n-1)^{th}$ row and the gate line in the $(2n)^{th}$ row to output the effective gate driving signals simultaneously, to turn on the switching elements whose control electrodes are electrically connected to the gate line in the $(2n-1)^{th}$ row and the switching elements whose control electrodes are electrically connected to the gate line in the $(2n)^{th}$ row, and enable the data lines to provide respective $n^{th}$ data voltages to charge the corresponding subpixels.

8. The driving method according to claim 7, wherein the display period further comprises a pre-charging stage between adjacent display stages, wherein the pre-charging stage between an $n^{th}$ display stage and an $(n+1)^{th}$ display stage is an $n^{th}$ pre-charging stage; the driving method further comprises:

at the $n^{th}$ pre-charging stage, controlling the gate line in the $(2n-1)^{th}$ row, the gate line in the $(2n)^{th}$ row, a gate line in a $(2n+1)^{th}$ row and a gate line in a $(2n+2)^{th}$ row to provide the effective gate driving signals, to turn on the switching elements whose control electrodes are electrically connected to the gate line in the $(2n-1)^{th}$ row, the switching elements whose control electrodes are electrically connected to the gate line in the $(2n)^{th}$ row, the switching elements whose control electrodes are electrically connected to the gate line in the $(2n+1)^{th}$ row and the switching elements whose control electrodes are electrically connected to the gate line in the $(2n+2)^{th}$ row, and enable the data lines to provide the respective $n^{th}$ data voltages to charge the corresponding subpixels.

9. A display device, comprising the pixel structure according to claim 1.

10. The display device according to claim 9, further comprising a gate driving circuit and a data driving circuit;

the gate driving circuit is configured to control at least two gate lines in the plurality of gate lines to output effective gate driving signals simultaneously, to turn on the switching elements whose control electrodes are electrically connected to the at least two gate lines;

the data driving circuit is configured to provide a corresponding data voltage to the data line.

11. The display device according to claim 10, wherein in the plurality of subpixel circuits arranged in the array form, a subpixel circuit in a $(2n-1)^{th}$ row and an $m^{th}$ column comprises a subpixel in a $(2n-1)^{th}$ row and an $m^{th}$ column and a switching element in a $(2n-1)^{th}$ row and an $m^{th}$ column, a control electrode of the switching element in the $(2n-1)^{th}$ row and the $m^{th}$ column is electrically connected to a gate line in a $(2n-1)^{th}$ row, a first electrode of the switching element in the $(2n-1)^{th}$ row and the $m^{th}$ column is electrically connected to an $m^{th}$ first data line, and a second electrode of the switch element in the $(2n-1)^{th}$ row and the $m^{th}$ column is electrically connected to the subpixel in the $(2n-1)^{th}$ row and the $m^{th}$ column; a subpixel circuit in a $(2n)^{th}$ row and an $m^{th}$ column comprises a subpixel in a $(2n)^{th}$ row and an $m^{th}$ column and a switching element in a $(2n)^{th}$ row and an $m^{th}$ column, a control electrode of the switching element in the $(2n)^{th}$ row and the $m^{th}$ column is electrically connected to a gate line in the $(2n)^{th}$ row, a first electrode of the switching element in the $(2n)^{th}$ row and the $m^{th}$ column is electrically connected to the $m^{th}$ second data line, and a second electrode of the switch element in the $(2n)^{th}$ row and the $m^{th}$ column is electrically connected to the subpixel in the $(2n)^{th}$ row and the $m^{th}$ column; the $m^{th}$ first data line is a data line in an $m^{th}$ column among the plurality of data lines arranged in the columns, and the $m^{th}$ second data line is a data line in an $m^{th+1}$ column among the plurality of data lines arranged in the columns; or the $m^{th}$ first data line is the data line in the $m^{th+1}$ column among the plurality of data lines arranged in the columns, and the $m^{th}$ second data line is the data line in the $m^{th}$ column among the plurality of data lines arranged in the columns, where m and n are both positive integers; a display period comprises a plurality of display stages;

the gate driving circuit is configured to, at an $n^{th}$ display stage among the display stages, controlling the gate line in the $(2n-1)^{th}$ row and the gate line in the $(2n)^{th}$ row to output the effective gate driving signals simultaneously, to turn on the switching elements whose control electrodes are electrically connected to the gate line in the $(2n-1)^{th}$ row and the switching elements whose control electrodes are electrically connected to the gate line in the $(2n)^{th}$ row;

the data driving circuit is configured to, at the $n^{th}$ display stage, provide respective $n^{th}$ data voltages to the data lines, to charge the corresponding subpixels.

12. The display device according to claim 11, wherein the display period further comprises a pre-charging stage between adjacent display stages, wherein the pre-charging stage between an $n^{th}$ display stage and an $(n+1)^{th}$ display stage is an $n^{th}$ pre-charging stage; and the gate driving circuit is configured to, at the $n^{th}$ pre-charging stage, control the gate line in the $(2n-1)^{th}$ row, the gate line in the $(2n)^{th}$ row, a gate line in the $(2n+1)^{th}$ row and a gate line in the $(2n+2)^{th}$ row to provide the effective gate driving signals to turn on the switching elements whose control electrodes are electrically connected to the gate line in the $(2n-1)^{th}$ row, the switching elements whose control electrodes are electrically connected to the gate line in the $(2n)^{th}$ row, the switching elements whose control electrodes are electrically connected to the gate line in the $(2n+1)^{th}$ row and the switching elements whose control electrodes are electrically connected to the gate line in the $(2n+2)^{th}$ row;

the data driving circuit is configured to, at the $n^{th}$ pre-charging stage, provide the respective $n^{th}$ data voltages to the data lines, to charge the corresponding subpixels.

13. The display device according to claim 9, wherein the switching element is configured to control to charge the subpixel through a data voltage on the data line under control of a gate driving signal on the gate line.

14. The display device according to claim 9, wherein the control electrodes of the switching elements of the subpixel circuits in a same row are electrically connected to the same gate line;

in the plurality of subpixel circuits arranged in the array form, a subpixel circuit in a $(2n-1)^{th}$ row and an $m^{th}$ column is electrically connected to an $m^{th}$ first gate line, and a subpixel circuit in a $(2n)^{th}$ row and the $m^{th}$ column is electrically connected to an $m^{th}$ second data line; and the $m^{th}$ first data line is a data line in an $m^{th}$ column among the plurality of data lines arranged in the columns, and the $m^{th}$ second data line is a data line in an $m^{th+1}$ column among the plurality of data lines arranged in the columns; or the $m^{th}$ first data line is the data line in the $m^{th+1}$ column among the plurality of data lines arranged in the columns, and the $m^{th}$ second data line is the data line in the $m^{th}$ column among the plurality of data lines arranged in the columns, where m and n are both positive integers.

15. The display device according to claim 14, wherein the subpixel circuit in the $(2n-1)^{th}$ row and the $m^{th}$ column comprises a subpixel in a $(2n-1)^{th}$ row and an $m^{th}$ column and a switching element in a $(2n-1)^{th}$ row and an $m^{th}$ column, a control electrode of the switching element in the $(2n-1)^{th}$ row and the $m^{th}$ column is electrically connected to a gate line in a $(2n-1)^{th}$ row, a first electrode of the switching element in the $(2n-1)^{th}$ row and the $m^{th}$ column is electrically connected to the $m^{th}$ first data line, and a second electrode of the switch element in the $(2n-1)^{th}$ row and the $m^{th}$ column is electrically connected to the subpixel in the $(2n-1)^{th}$ row and the $m^{th}$ column;

the subpixel circuit in the $(2n)^{th}$ row and the $m^{th}$ column comprises a subpixel in a $(2n)^{th}$ row and an $m^{th}$ column and a switching element in a $(2n)^{th}$ row and an $m^{th}$ column, a control electrode of the switching element in the $(2n)^{th}$ row and the $m^{th}$ column is electrically connected to a gate line in the $(2n)^{th}$ row, a first electrode of the switching element in the $(2n)^{th}$ row and the $m^{th}$ column is electrically connected to the $m^{th}$ second data line, and a second electrode of the switch element in the $(2n)^{th}$ row and the $m^{th}$ column is electrically connected to the subpixel in the $(2n)^{th}$ row and the $m^{th}$ column.

16. The display device according to claim 9, wherein the switching element is a triode, a TFT or an FET.

17. The display device according to claim 16, wherein the switching element further comprises a first electrode and a second electrode, the subpixel is connected to the first electrode of the switching element, and the data line is connected to the second electrode of the switching element.

18. The display device according to claim 13, wherein in the plurality of subpixel circuits arranged in the array form, a subpixel circuit in a $(2n-1)^{th}$ row and an $m^{th}$ column comprises a subpixel in a $(2n-1)^{th}$ row and an $m^{th}$ column and a switching element in a $(2n-1)^{th}$ row and an $m^{th}$ column, a control electrode of the switching element in the $(2n-1)^{th}$ row and the $m^{th}$ column is electrically connected to a gate line in a $(2n-1)^{th}$ row, a first electrode of the switching element in the $(2n-1)^{th}$ row and the $m^{th}$ column is electrically connected to an $m^{th}$ first data line, and a second electrode of the switch element in the $(2n-1)^{th}$ row and the $m^{th}$ column is electrically connected to the subpixel in the $(2n-1)^{th}$ row and the $m^{th}$ column; a subpixel circuit in a $(2n)^{th}$ row and an $m^{th}$ column comprises a subpixel in a $(2n)^{th}$ row and an $m^{th}$ column and a switching element in a $(2n)^{th}$ row and an $m^{th}$ column, a control electrode of the switching element in the $(2n)^{th}$ row and the $m^{th}$ column is electrically connected to a gate line in the $(2n)^{th}$ row, a first electrode of the switching element in the $(2n)^{th}$ row and the $m^{th}$ column is electrically connected to the $m^{th}$ second data line, and a second electrode of the switch element in the $(2n)^{th}$ row and the $m^{th}$ column is electrically connected to the subpixel in the $(2n)^{th}$ row and the $m^{th}$ column; the $m^{th}$ first data line is a data line in an $m^{th}$ column among the plurality of data lines arranged in the columns, and the $m^{th}$ second data line is a data line in an $m^{th+1}$ column among the plurality of data lines arranged in the columns; or the $m^{th}$ first data line is the data line in the $m^{th+1}$ column among the plurality of data lines arranged in the columns, and the $m^{th}$ second data line is the data line in the $m^{th}$ column among the plurality of data lines arranged in the columns, where m and n are both positive integers; a display period comprises a plurality of display stages;

the gate driving circuit is configured to, at an $n^{th}$ display stage among the display stages, controlling the gate line in the $(2n-1)^{th}$ row and the gate line in the $(2n)^{th}$ row to output the effective gate driving signals simultaneously, to turn on the switching elements whose control electrodes are electrically connected to the gate line in the $(2n-1)^{th}$ row and the switching elements whose control electrodes are electrically connected to the gate line in the $(2n)^{th}$ row;

the data driving circuit is configured to, at the $n^{th}$ display stage, provide respective $n^{th}$ data voltages to the data lines, to charge the corresponding subpixels.

19. The display device according to claim 18, wherein the display period further comprises a pre-charging stage between adjacent display stages, wherein the pre-charging stage between an $n^{th}$ display stage and an $(n+1)^{th}$ display stage is an $n^{th}$ pre-charging stage; and the gate driving circuit is configured to, at the $n^{th}$ pre-charging stage, control the gate line in the $(2n-1)^{th}$ row, the gate line in the $(2n)^{th}$ row, a gate line in the $(2n+1)^{th}$ row and a gate line in the $(2n+2)^{th}$ row to provide the effective gate driving signals to turn on the switching elements whose control electrodes are electrically connected to the gate line in the $(2n-1)^{th}$ row, the switching elements whose control electrodes are electrically connected to the gate line in the $(2n)^{th}$ row, the switching elements whose control electrodes are electrically connected to the gate line in the $(2n+1)^{th}$ row and the switching elements whose control electrodes are electrically connected to the gate line in the $(2n+2)^{th}$ row;

the data driving circuit is configured to, at the $n^{th}$ pre-charging stage, provide the respective $n^{th}$ data voltages to the data lines, to charge the corresponding subpixels.

* * * * *